US012139684B2

(12) United States Patent
Yang

(10) Patent No.: US 12,139,684 B2
(45) Date of Patent: Nov. 12, 2024

(54) METHOD FOR MANUFACTURING COAL ADDITIVE

(71) Applicant: KOREA JINTECH, Incheon (KR)

(72) Inventor: Kidae Yang, Incheon (KR)

( * ) Notice: Subject to any disclaimer, the term of this patent is extended or adjusted under 35 U.S.C. 154(b) by 0 days.

(21) Appl. No.: 17/044,812

(22) PCT Filed: Mar. 6, 2019

(86) PCT No.: PCT/KR2019/002582
§ 371 (c)(1),
(2) Date: Oct. 1, 2020

(87) PCT Pub. No.: WO2019/182268
PCT Pub. Date: Sep. 26, 2019

(65) Prior Publication Data

US 2021/0355394 A1 Nov. 18, 2021

(30) Foreign Application Priority Data

Mar. 19, 2018 (KR) ..... 10-2018-0031551

(51) Int. Cl.
*C10L 5/10* (2006.01)
*C10L 9/10* (2006.01)

(52) U.S. Cl.
CPC ..... *C10L 5/105* (2013.01); *C10L 9/10* (2013.01); *C10L 2200/0213* (2013.01);
(Continued)

(58) Field of Classification Search
CPC .... C10L 5/105; C10L 9/10; C10L 2200/0213; C10L 2200/0218; C10L 2200/029; C10L 2250/02
See application file for complete search history.

(56) References Cited

U.S. PATENT DOCUMENTS

| | | | |
|---|---|---|---|
| 5,490,634 | A | 2/1996 | Jain et al. |
| 10,359,192 | B2 | 7/2019 | Comrie |
| 2010/0168494 | A1 | 7/2010 | Rappas et al. |

FOREIGN PATENT DOCUMENTS

| | | | |
|---|---|---|---|
| CN | 106467765 | * | 3/2017 |
| CN | 106479596 | * | 3/2017 |

(Continued)

OTHER PUBLICATIONS

KR Office Action dated Jun. 18, 2018 as received in Application No. 10-2018-0031551.

(Continued)

*Primary Examiner* — Cephia D Toomer
(74) *Attorney, Agent, or Firm* — Maschoff Brennan

(57) ABSTRACT

A method for manufacturing a coal additive that is added to coal as a solid fuel to microgranulate and uniformize the coal, thereby increasing the combustion area of the coal, leading to a decrease in combustion time and a reduction in unburned carbon generation. A raw material for the coal additive is prepared as a liquid phase by placing, in a container, a fermented liquid, which is an extract obtained from the incubation of fermenting bacteria (enzyme) in fruit residues, and an emulsion of metal ions and bentonite or gelrite, followed by mixing. Coal may be subjected to microgranulation and uniformization as a solid fuel by addition of the liquefied additive to the coal. The degree of coal powder is improved to increase combustion area, thereby shortening combustion time and reducing generation of unburned carbon, leading to increasing energy efficiency, which is environmentally friendly and safe and has remarkable effects.

1 Claim, 1 Drawing Sheet

(52) U.S. Cl.
CPC . *C10L 2200/0218* (2013.01); *C10L 2200/029* (2013.01); *C10L 2250/02* (2013.01)

(56) References Cited

FOREIGN PATENT DOCUMENTS

| | | | |
|---|---|---|---|
| JP | 2631826 | B2 | 7/1997 |
| JP | 2003-261890 | A | 9/2003 |
| JP | 2008-533432 | A | 8/2008 |
| KR | 10-1290423 | B1 | 7/2013 |
| KR | 10-1528471 | B1 | 6/2015 |
| KR | 10-2017-0031958 | A | 3/2017 |

OTHER PUBLICATIONS

KR Decision to Grant Dated Sep. 17, 2018 as received in Application No. 10-2018-0031551.

* cited by examiner

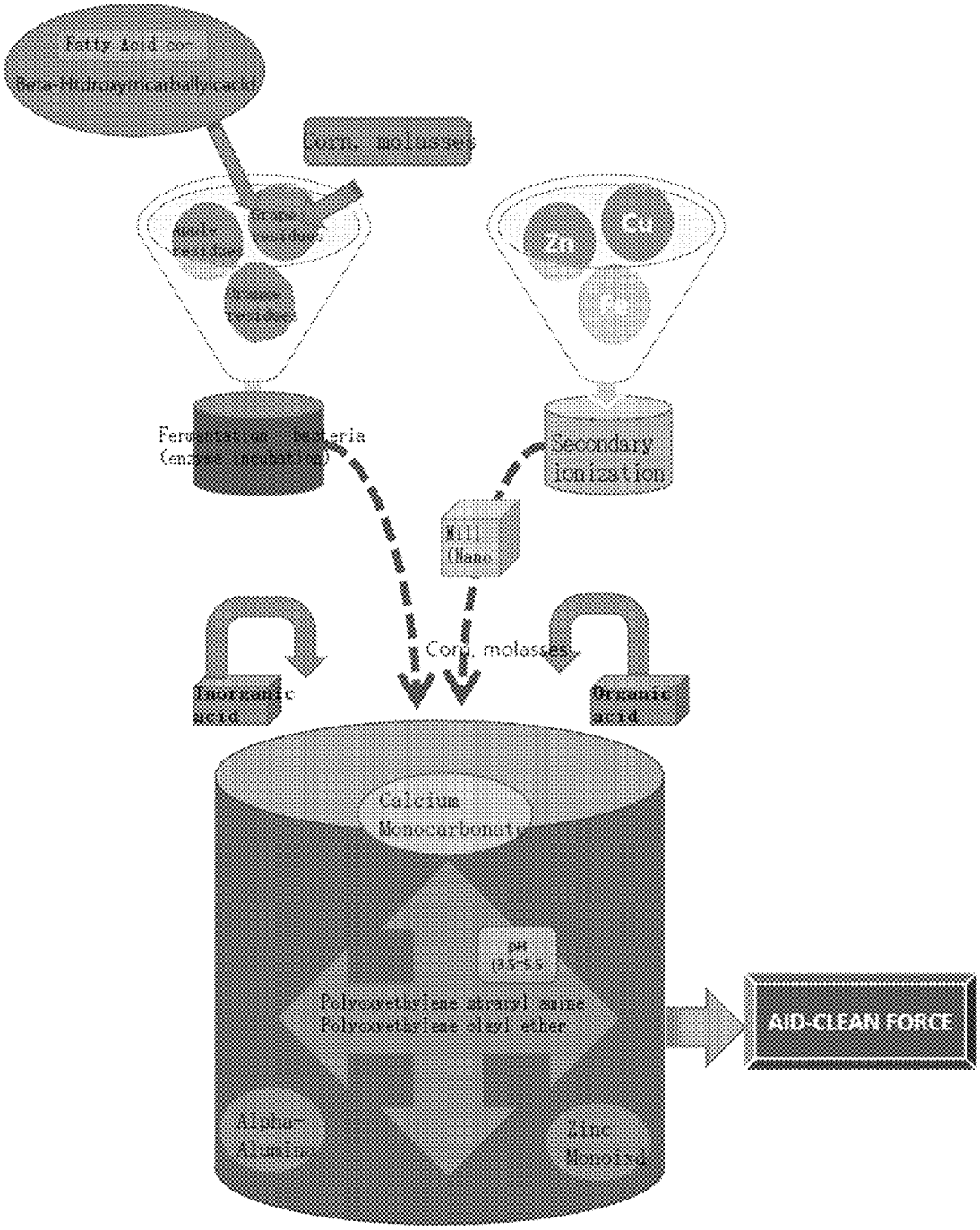
Fatty Acid co-
Beta-Hidroxytricarbolytic acid
Corn molasses
Zn
Secondary
Ionization
Mill
(Nano
Corn molasses
Inorganic
acid
Organic
acid
Calcium
Monocarbonate
pH
(5.5-6.5)
Polyoxyethylene alkanyl amine
Polyoxyethylene alkyl ether
Alpha-
Alanine
Zinc
Monoxide
AID-CLEAN FORCE

METHOD FOR MANUFACTURING COAL ADDITIVE

FIELD OF INVENTION

The present invention relates to a method for producing coal additives, and more specifically, to an eco-friendly method for producing a coal additive which is made of a fermentation broth as an extract prepared by incubating fermentation bacteria (enzyme) with fruit residues, wherein the additive is added to coal as a solid fuel, followed by micro-granulation and homogenization of the coal to increase a combustion area of the coal, thereby shortening a combustion time and decreasing an amount of unburned carbon.

BACKGROUND OF INVENTION

From long ago, fermentation technology has been developed all over the world. In particular, since fermentation occurs over time in fruit residues after eaten, it has been known for a long time that combustion proceeds more actively when the fruit residues are present near the flame. Therefore, on the basis of the above fact, it is obviously understood that an extract prepared by incubating fermentation bacteria (enzyme) on the residues of fruits such as apples, oranges and grapes is an eco-friendly element derived from nature.

In the 21st century, nano-elements have been developed and applied to a variety of areas such as IT, ET and BT. However, such development has mostly been directed to fuel oil additives and, in the case of relatively cheaper coal, expensive nano-elements are seldom applied now.

On the other hand, with regard to the production of a coal additive, conventional techniques such as micro-granulation and homogenization of coal after adding a coal additive to the coal as a solid fuel have been developed. As an example, Korean Patent Publication No. 10-1290423 discloses a manufacturing method of substantially free-flowable alkali-metal vaporization catalyst-supported coal micro-particles from coal feedstock, including: (A) providing a coal feedstock having an initial moisture content and an initial concentration of acidic functional groups; (B) grinding the coal feedstock;

(C) sorting the coal feedstock obtained in step (B) in a specific particle size profile to produce coal micro-particle shaving a matrix and a second concentration of acidic functional groups;

(D) bringing the coal micro-particles into contact with a predetermined amount of aqueous solution having a constant concentration of alkali-metal vaporization catalyst to prepare a wet cake of alkali-metal vaporization catalyst-supported coal micro-particles which has a specific ratio of alkali-metal atoms to carbon atoms and a second moisture content; and (E) heating the alkali-metal vaporization catalyst-supported coal micro-particle wet cake to reduce the second moisture content and thus produce alkali-metal vaporization catalyst-supported coal micro-particles as substantially free-flowable micro-particles, wherein (a) the second concentration of the acidic functional groups is at least 50% of the initial concentration; (b) the specific particle size profile has a d5 particle size of at least 20 micrometers, a d95 particle size of at most 1000 micrometers, and a d50 particle size of 75 to 350 micrometers;

(c) the specific ratio of alkali-metal atoms to carbon atoms in step (D) is sufficient to provide a ratio of alkali-metal atoms to carbon atoms ranging from 0.01 to 0.10 in the substantially free-flowable alkali-metal vaporization catalyst-supported coal micro-particles; (d) the alkali-metal vaporization catalyst-supported coal micro-particle wet cake in step (D) is substantially non-drainable; (e) the amount of aqueous solution and the concentration of the alkali-metal vaporization catalyst in step (D) are sufficient to provide a specific ratio of alkali-metal atoms to carbon atoms in the alkali-metal vaporization catalyst-supported coal micro-particle wet cake; (f) the contacting in step (D) is carried out for a predetermined period of time under stirring at elevated temperature not more than substantially a boiling point of the aqueous solution and at substantially atmospheric pressure, wherein each of the materials under contact is contained in a sufficient amount to enable a substantially uniform distribution of alkali-metal vaporization catalyst within a non-drainable alkali-metal vaporization catalyst-supported coal micro-particle wet cake; (g) the non-drainable alkali-metal vaporization catalyst-supported carbonaceous micro-particle wet cake exits step (D) at a first temperature and passes through the heating step (E) at substantially the same temperature; and (h) substantially free-flowable alkali-metal vaporization catalyst-supported coal micro-particles contain a predetermined amount of alkali-metal atoms, wherein more than 50% of alkali-metal atoms are combined with the coal micro-particle matrix by ion exchange at acidic functional groups.

Further, Korean Patent Publication No. 10-1528471 discloses an additive for improving powdery flow in order to enhance fluidity of coal starch, which includes: at least one high-absorptive resin selected from starch, starch-polyacrylate polymer, vinyl alcohol-sodium acrylate polymer, polyacrylic acid-starch graft polymer, polyacrylate polymer, polyethylene oxide polymer, polyacrylic acid-polyvinylalcohol copolymer, isobutylene-maleic acid copolymer, methylcellulose, hydroxyethylcellulose, sodium carboxymethylcellulose-based polymer, graft polymer of polyacrylic acid and natural polymer, gelatin, polyglycol and polyacrylic acid; and, at least one water-repellent organic particle selected from ethylene-vinylacetate copolymer, polyethylene, polypropylene, polydimethylsiloxane, polystyrene, polymethylmethacrylate, polysulfone, polyethersulfone, polyetherimide, polyimide and polycarbonate added to the high-absorptive polymer.

However, the above-described prior arts have disadvantages in that the coal powder is not sufficiently micro-granulated and homogenized, whereby the coal has low powder density to decrease a combustion area, which in turn delays a combustion time while not decreasing an amount of unburned carbon, hence reducing energy efficiency.

SUMMARY OF INVENTION

Technical Problem to be Solved

Therefore, the present invention has been proposed to overcome the aforementioned problems, and an object of the present invention is to provide a method for producing a coal additive, including: adding a liquid additive to coal as a solid fuel to induce micro-granulation and homogenization of the coal, so as to increase a combustion area while improving a powder density of the coal, which in turn shortens a combustion time and decreases an amount of unburned carbon to thus improve energy efficiency.

Technical Solution

The present invention relates to a method for production of a coal additive which includes adding an additive to coal as a solid fuel to induce micro-granulation and homogenization of the coal, thereby shortening a combustion time while decreasing an amount of unburned carbon.

Herein, the additive may be prepared in a liquid state by mixing raw materials in a container, wherein the raw materials include: a fermentation broth, which is an extract obtained by incubating fermentation bacteria (enzyme) on fruit residues; and an emulsion of metal ions and bentonite or Gelite.

Effect of Invention

Therefore, according to the present invention, a liquid additive is added to coal as a solid fuel to induce micro-granulation and homogenization of the coal, whereby a powder density of the coal is improved and a combustion area is increased, thus shortening a combustion time, and a frequency of clinker generation in a furnace is considerably reduced to thus decrease an amount of unburned carbon, thereby enhancing energy efficiency. Therefore, the present invention may attain eco-friendly and remarkably safe effects.

BRIEF DESCRIPTION OF DRAWINGS

FIG. 1 is a process flowchart illustrating the method for production of the coal additive according to the present invention.

BEST MODE

The present invention relates to a method for production of a coal additive, which includes adding an additive to coal as a solid fuel to induce micro-granulation and homogenization of the coal, so as to increase a combustion area and thus shorten a combustion time while decreasing an amount of unburned carbon, wherein the additive is prepared in a liquid state by mixing raw materials in a container, and the raw materials include: a fermentation broth, which is an extract obtained by incubating fermentation bacteria (enzyme) on fruit residues; and an emulsion of metal ions and bentonite or Gelite.

In addition, the raw materials may further include inorganic acid or organic acid.

Further, the metal ions may include calcium monocarbonate, alpha alumina, zinc monoxide, polyoxyethylenestearylamine or polyoxyethyleneoleylether.

In addition, the fruit residues may further include inorganic acid and organic acid.

In addition, raw materials of the fermentation broth may further include corn or molasses.

Further, the fruit residues may be acidic residues, for example, residues of grapes, apples or oranges.

Further, the raw materials of the fermentation broth may further include fatty acid co-oligomer or beta-hydroxytricarballyic acid added thereto.

Further, in fermentation of the present invention, pH may range from 3.5 to 5.5.

DETAILED DESCRIPTION OF PREFERRED EMBODIMENTS OF INVENTION

The present invention will be described in detail by means of the accompanying drawings. FIG. 1 is a process flowchart illustrating the method for production of a coal additive according to the present invention.

With regard to the coal additive of the present invention, the extract made by incubating fermentation bacteria (enzyme) on fruit residues is an environmentally friendly ("eco-friendly") element made from nature.

According to the present invention, an additive is added to coal as a solid fuel to induce micro-granulation and homogenization of the coal to thus increase a combustion area while shortening the combustion time, and further to considerably reduce a frequency of clinker generation in a furnace, thereby decreasing an amount of unburned carbon.

Raw materials of the additive may include: a fermentation broth which is an extract obtained by incubating fermentation bacteria (enzyme) on fruit residues; and an emulsion of metal ions and bentonite or Gelite. Herein, the raw materials are mixed in a container to prepare the additive in a liquid state.

The fruit residues used herein may include mainly residues of grapes, apples or oranges, and pH in fermentation may range from 3.5 to 5.5.

The metal ions added in the present invention may include, for example, calcium monocarbonate, alpha alumina, zinc monoxide, polyoxyethylenestearylamine, or polyoxyethyleneoleylether.

In another embodiment, the raw material of the coal additive may further include an inorganic acid or an organic acid.

In another embodiment, the fermentation broth may further include corn or molasses.

On the other hand, in another embodiment, the raw material of the fermentation broth may further include fatty acid co-oligomer or beta-hydroxytricarballyic acid added thereto.

The present invention is characterized by a combination of fermentation (enzyme) and nano-ions.

More particularly, fermentation (enzyme) and emulsification using a carrier such as bentonite (including zeolite) are used.

Further, the nano-ions used herein may include all of Cu, Zn, Au, Pt, Fe, Mg, etc., as well as transition metals.

Further, bentonite+a portion of alkali-metal compound are introduced.

Further, according to an embodiment of the present invention, the fermentation broth based on fruit residues may be prepared by mixing 45 to 55 parts by weight ("wt. parts") of fatty acid co-oligomer and 45 to 50 wt. parts of fruit residues to 100 wt. parts of $H_2O$. A fermentation time may range from 7 to 10 days. Further, an inorganic acid/organic acid solution made of inorganic acid and organic acid in a 1:1 ratio may be added wherein 45 to 55 wt. parts of fatty-acid co-oligomer, 45 to 55 wt. parts of fruit residues and 3 to 10 wt. parts of inorganic acid/organic acid solution are mixed with 100 wt. parts of $H_2O$, thus preparing the fermentation broth.

In addition, 95 to 105 wt. parts of bentonite and 95 to 105 wt. parts of metal ions are mixed with 10 to 30 wt. parts of $H_2O$, thus preparing an emulsion of metal ions and bentonite or Gelite. In this case, the preparation may take about 7 days.

Thereafter, the fermentation broth based on fruit residues as well as the emulsion of metal ions and bentonite or Gelite may be mixed in a mixing ratio of 50 wt. parts of the fruit residue fermentation broth and 50 wt. parts of the emulsion of metal ions and bentoite or Gelite relative to 10 to 20 wt. parts of $H_2O$, followed by agitating the mixture at 60 to 90° C. for 10 to 12 hours.

In this regard, inorganic acid/organic acid may be further added and mixed in a mixing ratio of 50 wt. parts of the fruit residue fermentation broth, 50 wt. parts of the emulsion of metal ions and bentonite or Gelite, and 3 to 10 wt. parts of inorganic acid/organic acid relative to 10 to 20 wt. parts of $H_2O$.

The present invention has effects of the liquid additive in micro-granulation and homogenization of coal as a solid fuel, as well as effects of reducing a bonding force of a linkage in molecules. The present invention may improve a powder density and increase a combustion area, thus shortening a combustion time while decreasing an amount of unburned carbon.

In other words, a content of unburned carbon powder in combustion accelerating fly-ash and bottom-ash as well as an amount of ash generation may be reduced. In addition, CO gas generation due to complete combustion is significantly reduced by about 75 to 85%.

Further, sulfur oxides (SOx) and nitrogen oxides (NOx), which are representative hazardous substances generated during combustion of coal, may be reduced by about 45 to 60%.

In other words, the exhaust gas may be combined with SOx gas containing reduced pollutant and then be discharged in the form of dust.

Further, since combustion characteristics are remarkably improved, amounts of generated slag, soot and clinker may be significantly decreased. That is, the additive of the present invention does not react with clinker peel-off ash and a metal component, but contacts the clinker to peel off the same. Thermal conductivity is increased due to clinker removal and prevention of clinker generation, thereby achieving energy savings.

As oxygen generating heat is applied, a large amount of oxygen is generated and penetrates into coal particles to thus afford a direct oxygen source, thereby accelerating combustion. An anti-corrosive coating with anti-corrosive micro-bearing effects may be formed. Emission of exhaust gas is reduced by air flow control, and scale deposited to A/H, a cutter, etc. is removed, thus improving efficiency. The present invention is therefore used as an eco-friendly and safe coal additive.

INDUSTRIAL APPLICABILITY

The present invention provides an eco-friendly and safe coal additive, produced by adding a liquid additive to coal as a solid fuel to thus induce micro-granulation and homogenization of the coal, so that the coal additive can be supplied to coal-fired power plants throughout the world in order to increase a combustion area while improving a powder density of coal, thereby shortening a combustion time, can considerably reduce a frequency of clinker generation in a furnace to reduce unburned carbon generation and enhance energy efficiency, and can decrease CO gas and hazardous substances such as sulfur oxides (SOx) and nitrogen oxides (NOx).

The invention claimed is:

1. A method for production of a coal additive for inducing micro-granulation and homogenization of coal, wherein the coal additive is prepared in a liquid state by mixing raw materials in a container, and the raw materials include: a fermentation broth, which is an extract obtained by incubating fermentation bacteria (enzyme) on fruit residues; and an emulsion of metal ions and bentonite or Gelite, the fruit residues further include inorganic acid and organic acid, the fruit residues are acidic residues including residues of grapes, apples or oranges, the metal ions include calcium monocarbonate, alpha alumina or zinc monoxide, the fruit residue fermentation broth is prepared by mixing 45 to 55 parts by weight ("wt. parts") of fatty acid co-oligomer, 45 to 55 wt. parts of fruit residues and 3 to 10 wt. parts of an inorganic acid/organic acid solution relative to 100 wt. parts of $H_2O$, wherein a fermentation time ranges from 7 to 10 days, the inorganic acid/organic acid solution is a mixture of inorganic acid and organic acid in a 1:1 ratio, and the emulsion of metal ions and bentonite or Gelite is prepared by mixing 95 to 105 wt. parts of bentonite or Gelite and 95 to 105 wt. parts of metal ions with 10 to 30 wt. parts of $H_2O$, and wherein the fruit residue fermentation broth, the emulsion of metal ions and bentonite or Gelite and the inorganic acid/organic acid solution are mixed in a mixing ratio of 50 wt. parts of the fruit residue fermentation broth, 50 wt. parts of the emulsion of metal ions and bentonite or Gelite and 3 to 10 wt. parts of the inorganic acid/organic acid solution, relative to 10 to 20 wt. parts of $H_2O$, followed by agitating the mixture at 60 to 90° C. for 10 to 12 hours.

* * * * *